US008734305B1

(12) United States Patent
Hoole

(10) Patent No.: US 8,734,305 B1
(45) **Date of Patent: *May 27, 2014**

(54) EXERCISE ARM AND METHOD OF USE

(76) Inventor: Richard J. Hoole, New Smyrna Beach, FL (US)

( * ) Notice: Subject to any disclaimer, the term of this patent is extended or adjusted under 35 U.S.C. 154(b) by 489 days.

This patent is subject to a terminal disclaimer.

(21) Appl. No.: 12/944,808

(22) Filed: Nov. 12, 2010

Related U.S. Application Data

(63) Continuation-in-part of application No. 11/811,920, filed on Jun. 11, 2007, now Pat. No. 7,871,360, and a continuation-in-part of application No. 12/156,487, filed on Jun. 2, 2008, now Pat. No. 7,918,770, and a continuation-in-part of application No. 12/658,855, filed on Feb. 16, 2010, now Pat. No. 8,147,389.

(51) Int. Cl.
*A63B 21/00* (2006.01)

(52) U.S. Cl.
USPC ..... 482/96; 482/95; 482/105; 482/142; 482/130; 482/124

(58) Field of Classification Search
USPC ..... 482/96, 95, 105, 142, 130, 124, 127
See application file for complete search history.

(56) References Cited

U.S. PATENT DOCUMENTS

| | | | | |
|---|---|---|---|---|
| 3,207,511 | A | 9/1965 | Hoffman | |
| 3,707,285 | A | 12/1972 | Martin | |
| 3,861,675 | A | 1/1975 | Hopper | |
| 4,111,414 | A | 9/1978 | Roberts | |
| 4,188,029 | A | 2/1980 | Brower et al. | |
| 4,372,553 | A | 2/1983 | Hatfield | |
| 4,598,908 | A * | 7/1986 | Morgan | 482/138 |
| 4,620,701 | A | 11/1986 | Mojden | |
| 4,645,197 | A | 2/1987 | McFee | |
| 5,158,520 | A * | 10/1992 | Lemke et al. | 482/133 |
| 5,277,684 | A | 1/1994 | Harris | |
| 5,322,489 | A | 6/1994 | Webb et al. | |
| 5,372,556 | A | 12/1994 | Ropp | |
| 5,496,242 | A * | 3/1996 | Wang | 482/97 |
| 5,580,340 | A | 12/1996 | Yu | |
| 5,637,063 | A * | 6/1997 | Fuller, Sr. | 482/97 |
| 7,029,426 | B1 * | 4/2006 | Fuller, Sr. | 482/97 |
| 7,101,322 | B2 * | 9/2006 | Carle | 482/97 |
| 7,166,066 | B2 | 1/2007 | Webber | |
| 2002/0132706 | A1 | 9/2002 | Sleamaker | |
| 2004/0018921 | A1 | 1/2004 | Smith | |
| 2005/0096198 | A1 | 5/2005 | Webber et al. | |
| 2005/0233875 | A1 | 10/2005 | Clarke et al. | |
| 2007/0197353 | A1 | 8/2007 | Hundley | |

* cited by examiner

*Primary Examiner* — Jerome W Donnelly
(74) *Attorney, Agent, or Firm* — Paul S. Rooy

(57) ABSTRACT

An exercise arm apparatus and method of use. The exercise arm comprises at least one finger, a spindle attached to the finger, and weights sized to reside on the spindle. One end of the exercise arm is rotatably attached at a pivot point to a frame or to a vertical surface; a belt is attached to an opposite end of the exercise arm by means of a belt line. Where the exercise arm is rotatably attached to a frame, dip bars and chin bars are disclosed wherein an exerciser may perform dips and chins. Upward motion by an exerciser wearing the belt is impeded by spindle weights, a belt elastic attached at one end to the belt and at an opposite end to the exercise arm, and/or an elastic member attached at one end to the frame and at an opposite end to the exercise arm.

26 Claims, 6 Drawing Sheets

EXERCISE ARM AND METHOD OF USE

CLAIM FOR PRIORITY

This application is a continuation-in-part of pending U.S. patent application Ser. No. 11/811,920 filed Jun. 11, 2007, U.S. patent application Ser. No. 12/156,487 filed Jun. 2, 2008, and Ser. No. 12/658,855 filed Feb. 16, 2010 and claims the benefit of the earlier filing date of these applications.

BACKGROUND OF THE INVENTION

1. Field of the Invention

This invention relates to exercise machines, and in particular to an exercise arm apparatus and method of use.

2. Background of the Invention

The exercise arm apparatus and method of use described herein may be used for squat, dip, and chin exercises.

Squats exercise the muscles of the thighs, hips and buttocks, and also strengthen the bones, ligaments and tendons throughout the lower body. For this reason, squats are regarded as an important exercise for strength-increase in the legs and buttocks.

Ideally, a squat exercise series begins from a standing position. The knees and hips are bent to lower the torso, and then the body is then returned to the upright position. The squat can continue to a number of depths, but a correct squat should be at least to parallel and usually lower if flexibility allows. Squatting below parallel qualifies a squat as deep while squatting above it qualifies as shallow. A below-parallel squat relies on hip drive out of the bottom, thereby exercising the adductors, glutes, and hamstrings to provide power. The knee is not used to stabilize or intercept any part of the load as with a shallow-type squat. Correctly performed full squats can be safe on the knees while removing pressure from the lower lumbar region.

As the body descends, the hips and knees undergo flexion, the ankle dorsiflexes and muscles around the joint contract eccentrically, reaching maximal contraction at the bottom of the movement while slowing and reversing descent. The muscles around the hips provide the power out of the bottom. If the knees slide forward or cave in then tension is taken from the hamstrings, hindering power on the ascent. Returning to vertical contracts the muscles concentrically, and the hips and knees undergo extension while the ankle plantar flexes.

Dips are performed by pushing oneself above the level of a pair of parallel dip bars located approximately shoulder-width apart. The exerciser grasps a dip bar with each hand, then lowers his or her body until elbows are bent and shoulders mildly stretched. The arms are used to push the exerciser upwards to the starting position. Leaning the body forward with elbows kept in works the chest muscles more. Keeping the body straight vertically with elbows close to the body works the triceps more. More strenuous dips can be accomplished by not permitting the exerciser's feet to touch the floor at all during the course of the exercise.

Chins are performed by pulling oneself upwards above a pair of roughly co-linear chin bars, grasping one bar with each hand. The chin bars are located above the shoulder height of the exerciser. The exerciser begins by grasping a chin bar with each hand, with palms facing the exerciser. The exerciser then pulls himself or herself upwards until either chin or chest touches the chin bars. The exerciser then slowly lowers himself or herself back to the standing position from which the chin exercise was initiated. Chin exercises strengthen the biceps, forearms, and lateral muscles.

One of the hardest problems to solve associated with currently available squat, dip, and chin exercise apparatus is the inability to add resistance acting against the exerciser's upward motion during squats, dips and chins, thereby rendering the exercise more strenuous. Currently available squat-dip-chin machines are either not weightable, or provide means to use weights to aid the exerciser during the exercise, thus rendering the exercise less strenuous. Thus, in order to make the dips and chins more strenuous it would be desirable to provide means of adding weight against the exercise being performed, not in aid of the exercise. In addition, it would be desirable to provide means for using elastic to work against the exercise, thus increasing the exercise value.

One currently available option is for the exerciser to wear a weight belt, from which weights dangle. While these weights have the effect of increasing the weight of the exerciser, and hence the strenuousness of the exercise, the procedure can be dangerous if the weights swing into the exerciser's limb(s), or if the exerciser were to slip off of the elevated foot support(s) and the heavy weights land on the exerciser's feet or other body part. Thus, it would be desirable to provide a safe way to add force against the squat, dip or chin being performed, by safely adding weight acting against the squat, dip or chin being performed.

It would also be desirable to provide a safe way to add force against the squat, dip or chin being performed, by safely adding elastic members acting against the squat, dip or chin being performed.

SUMMARY OF THE INVENTION

Accordingly, it is an object of the present invention to provide an exercise arm apparatus which provides a varying amount of weight which the exerciser can add acting against the dip or chin being performed. Design features allowing this object to be accomplished include an arm pivotally attached to at least one pivot point, an arm spindle on the arm, and weights sized to fit onto the arm spindle. Advantages associated with the accomplishment of this object include the ability to adjust the intensity of squats, dips and chins being performed, and the consequent enhancement of the exercise experience to the exerciser.

It is another object of the present invention to provide an exercise arm apparatus which provides a varying amount of resistance which the exerciser can add acting against the dip or chin being performed. Design features allowing this object to be accomplished include an arm pivotally attached to at least one pivot point, at least one pin attached to the frame, and an elastic member connecting a pin with the arm spindle, and/or an elastic band connecting a pin with a belt worn by the exerciser, and/or weights depending from the belt worn by the exerciser. Advantages associated with the accomplishment of this object include the ability to adjust the intensity of squats, dips and chins being performed, and the consequent enhancement of the exercise experience to the exerciser.

It is still another object of this invention to provide an exercise arm apparatus to which weights and force may be added safely which resist the squats, dips and chins being performed. Design features enabling the accomplishment of this object include an arm pivotally attached to a frame, an arm spindle attached to the arm, weights which may be removably installed on the arm spindle, and a belt worn by the exerciser attached to the arm by means of a belt line. Advantages associated with the realization of this object include elimination of heavy weights dangling from an exerciser's weight belt, consequent reduction of the possibility of injury to the exerciser from these weights.

It is still another object of this invention to provide an exercise arm apparatus to which provides varying distances between dip bar and belt attach points. Design features enabling the accomplishment of this object include an arm pivotally attached to at least one pivot point, and an arm extension rigidly attached to and end of the arm opposite the at least one pivot point. Advantages associated with the realization of this object include the ability to accommodate varying sizes of exercisers using the machine.

It is another object of this invention to provide method of use for an exercise arm apparatus to which weights and force may be added safely which resist the squats, dips and chins being performed. Method steps enabling the accomplishment of this object include providing an arm pivotally attached to a frame, an arm spindle attached to the arm, weights which may be removably installed on the arm spindle, and a belt worn by the exerciser attached to the arm by means of a belt line; emplacing weights on the spindle; an exerciser donning the belt; and the exerciser performing squat, dip or chin exercises. Advantages associated with the realization of this object include elimination of heavy weights dangling from an exerciser's weight belt, consequent reduction of the possibility of injury to the exerciser from these weights.

It is yet another object of this invention to provide an exercise arm apparatus which is inexpensive to manufacture. Design features allowing this object to be achieved include the use of components made of readily available materials, and the use of existing weights which may be removably added to an arm spindle. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Six sheets of drawings are provided. Sheet one contains FIG. 1. Sheet two contains FIG. 2. Sheet three contains FIG. 3. Sheet four contains FIG. 4. Sheet five contains FIG. 5. Sheet six contains FIG. 6.

DETAILED DESCRIPTION OF THE PREFERRED EMBODIMENT

Figure 1:
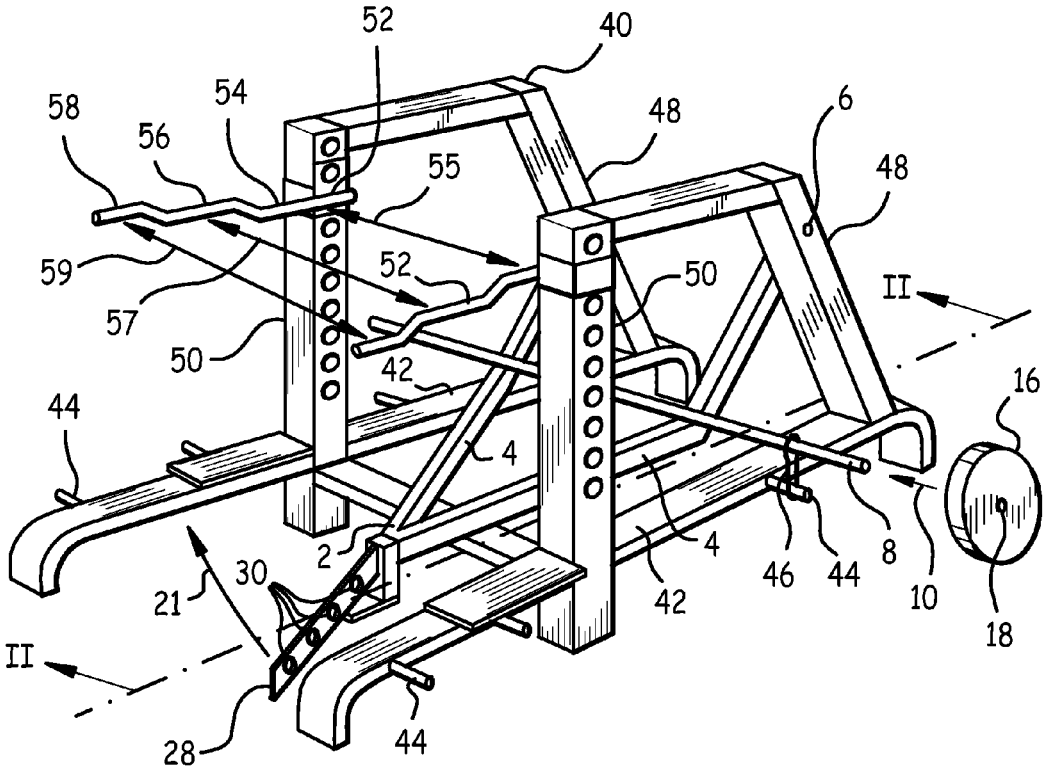
FIG. 1 is a right quarter side isometric view of an exercise arm apparatus attached to a frame having dip bars.
Figure 2:
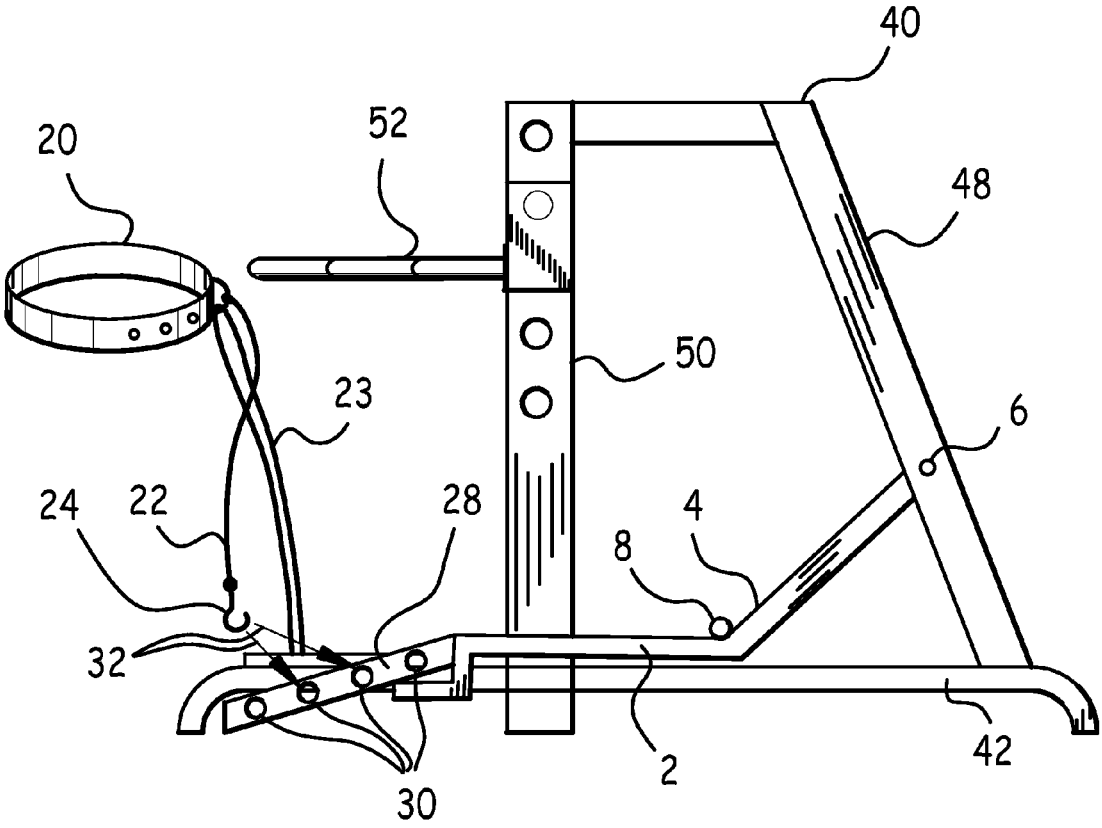
FIG. 2 is a right side cross-sectional view of an exercise arm apparatus with its arm in the resting position, taken at section II-II of FIG. 1.

FIG. 1 is a right quarter side isometric view of an exercise arm 2 attached to frame 40 having dip bars 52. FIG. 2 is a right side cross-sectional view of an exercise arm apparatus with its arm 2 in the resting position, taken at section II-II of FIG. 1. Frame 40 comprises at least one rear upright 48 rigidly attached to base 42, rising upwards from base 42. Base 42 may be any appropriately stable base to which rear uprights 48 and front uprights 50 may be attached. Exercise arm 2 comprises at least one finger 4 rotatably attached to a corresponding rear upright 48 at a pivot point 6.

Exercise arm 2 further comprises spindle 8 rigidly attached to finger 4. One or more weights 16 having weight apertures 18 sized to slidably admit spindle 8 may be emplaced on spindle 20 by sliding spindle 20 through weight aperture 18 as indicated by arrow 10 in FIG. 1.

When a desired number of weights 16 have been emplaced on spindle 8, an exerciser wearing belt 20 may attach belt hook 24 to exercise arm 2. Belt hook 24 is attached to belt 20 by means of belt line 22. The exerciser may then perform squat exercises as desired, with weights 16 as well as the weight of exercise arm 2 exerting force downwards against upward motion of the exerciser while returning to the vertical. As the exerciser returns to the vertical, arm 2 rotates upwards around pivot point 6 as indicated by arrow 21 in FIG. 1. During the descent portion of the squat, arm 2 rotates downwards around pivot point 6 opposite arrow 21 in FIG. 1.

Exercise arm 2 may comprise extension 28 rigidly attached to an end of extension arm 2 opposite pivot points 6. Extension 28 comprises a plurality of extension apertures 30 sized to admit belt hook 24. Belt hook 24 may be inserted into different extension apertures 30 as indicated by arrows 32 in FIG. 2, in order to accommodate differently sized exercisers.

Figure 4:
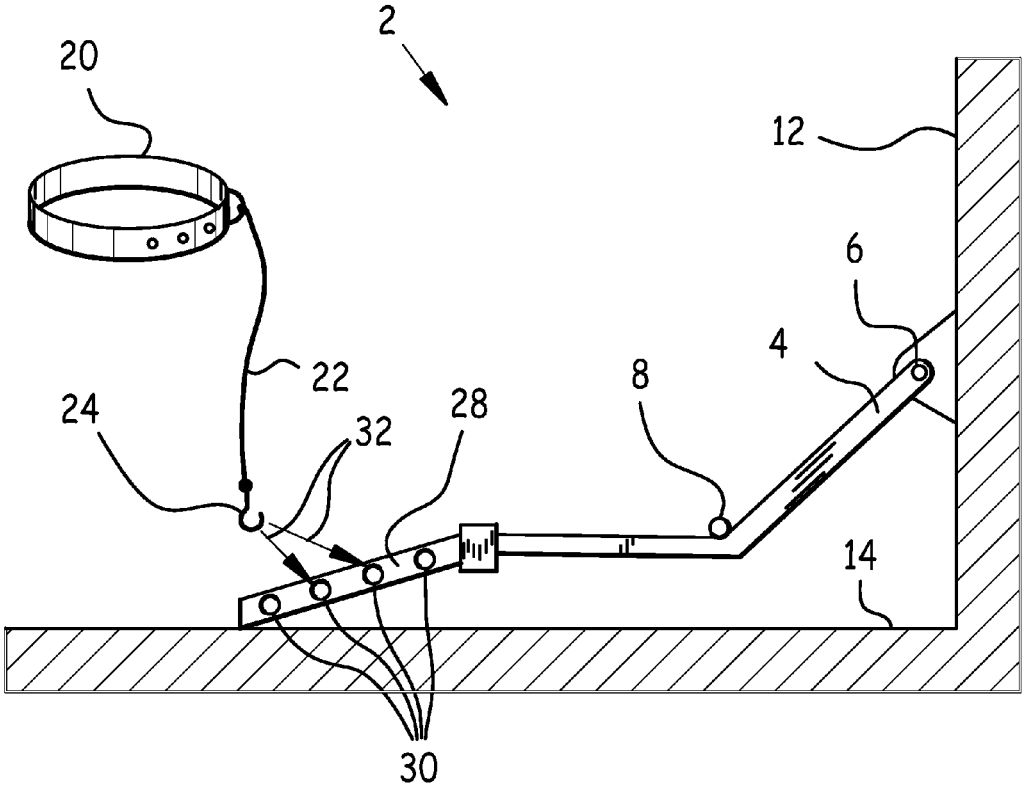
FIG. 4 is a right side view of an exercise arm apparatus pivotally attached to a vertical surface.

Because extension 28 slopes downwardly relative to a horizontal surface upon which frame 40 rests, different extension apertures 30 are at varying heights above horizontal surface 14, as may be more clearly observed in FIG. 4. Thus, changing the extension aperture 30 with which belt hook 24 is engaged has the effect of varying the height above horizontal surface 14 at which belt 20 is attached to exercise arm 2, thus accommodating differently sized exercisers.

Figure 5:
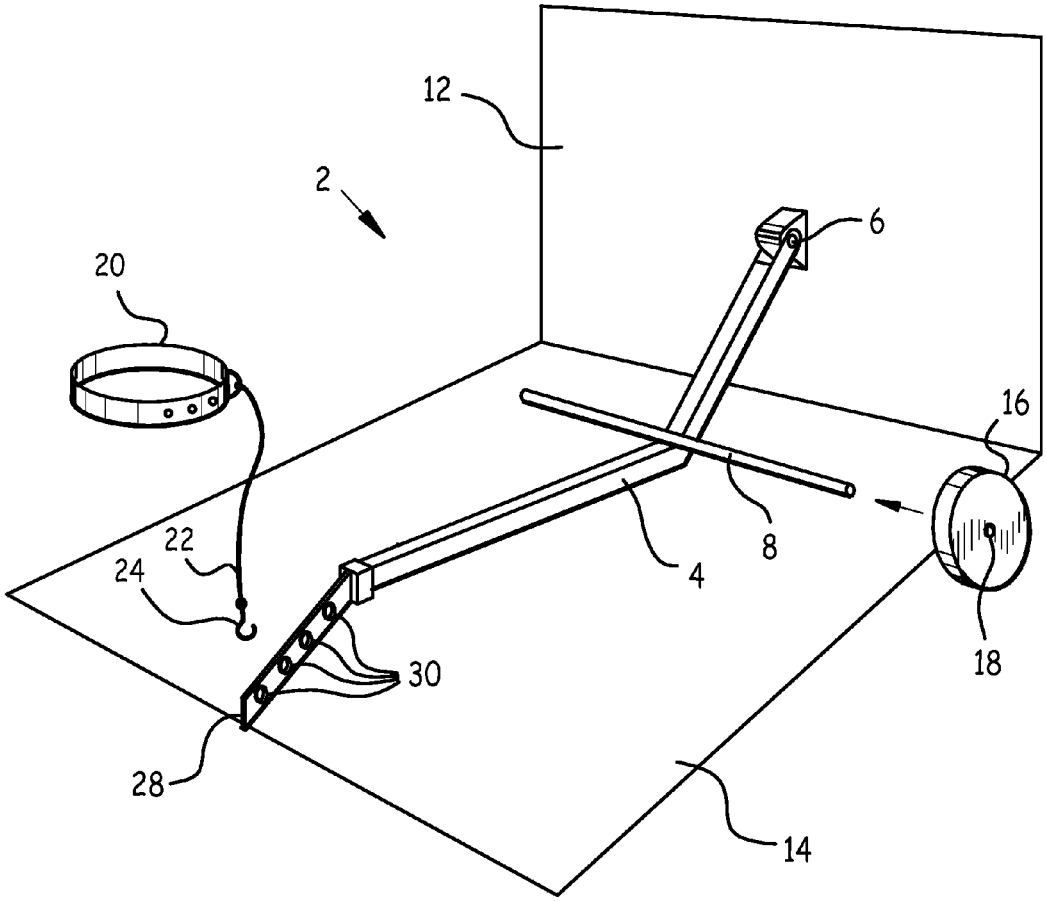
FIG. 5 is a right quarter side isometric view of an exercise arm apparatus having one finger, which is pivotally attached to a vertical surface.

The foregoing description describes an exercise arm 2 having a single finger 4 rotatably attached to a single rear upright 48. In this single-finger exercise arm 2 embodiment, exercise arm 2 would be as illustrated in FIG. 5, except pivot point 6 would be on a corresponding rear upright 48 rather than on a vertical surface 12.

Another embodiment of exercise arm 2 comprises two fingers 4, as depicted in FIG. 1. In this embodiment, an end of each finger 4 is rotatably attached to a corresponding rear upright 48 at a corresponding pivot point 6. Ends of fingers 4 opposite pivot points 6 are mutually rigidly attached. If present, extension 28 is attached at an end of fingers 4 opposite pivot points 6.

Frame 40 with pivotally attached exercise arm 2 may further comprise a pair of spaced front uprights 50. A dip bar 52 may be height-adjustably attached to each front vertical upright 50. Dip bars 52 extend substantially horizontally from front uprights 50 away from rear uprights 48. In use, an exerciser installs the weights 16 desired on spindle 8, adjusts the height of dip bars 52 on front uprights 50 to suite the height of the exerciser, dons belt 20, engages belt hook 24 with exercise arm 2, grasps a dip bar 52 with each hand, and performs dip exercises.

Elastic means of resisting upward motion of exercise arm 2 may also be incorporated into the combination exercise arm 2 and frame 40 described herein. Referring to FIG. 1, elastic member 46 may attach spindle 8 to base 42, e.g. around a peg 44 rigidly attached to base 42. In addition, belt elastic 23 may attach exercise arm 2 to base 42, e.g. around a peg 44 rigidly attached to base 42. Singly or in combination, elastic member 46 and/or belt elastic 23 serve to impede upward motion of exercise arm 2 during squats, dips and chins (where chin bars are provided, described below in connection with FIG. 6), thus increasing the rigorousness of these exercises.

As noted above, to accommodate different sized exercisers, a plurality of extension apertures 30 are provided which belt hook 26 may be engaged with. Another provision to accommodate differently-sized exercisers is the height-adjustability of dip bars 52 on front uprights 50. Height adjustability of dip bars 52 on front uprights 50 may be accomplished via any appropriate height adjustment means known in the art. Still another provision to accommodate differently-sized exercisers incorporated in the instant invention are the different spacings available between dip bars 52.

Each dip bar 52 may comprise a dip bar first leg 54, a dip bar second leg 56 spaced farther away from the other dip bar 52 than dip bar first leg 54, and a dip bar third leg 58, spaced farther away from the other dip bar 52 than dip bar second leg 56. Dip bar first legs 54 are separated by dip bar first distance 55, dip bar second legs 56 are separated by dip bar second distance 57, and dip bar third legs 58 are separated by dip bar third distance 59. Dip bar second distance 57 is greater than dip bar first distance 55, and dip bar third distance 59 is greater than dip bar second distance 57.

Thus, the farther the exerciser moves from front uprights 50, the farther apart dip bars 52 are spaced. The exerciser has merely to choose the dip bar 52 separation best suited for the exerciser's physique.

Figure 3:
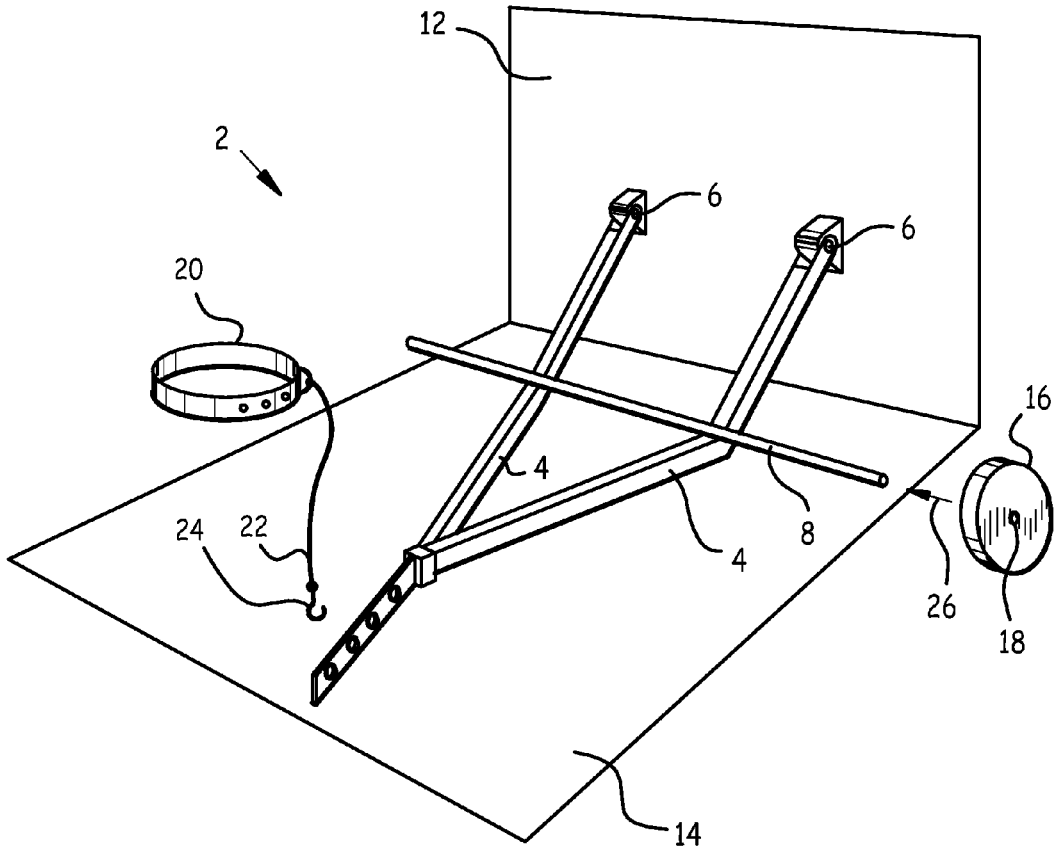
FIG. 3 is a right quarter side isometric view of an exercise arm apparatus having two fingers, which are pivotally attached to a vertical surface.

FIG. 3 is a right quarter side isometric view of an exercise arm 2 having two fingers 4, which are pivotally attached at pivot points 6 to a vertical surface 12. FIG. 4 is a right side view of an exercise arm 2 pivotally attached to a vertical surface 12. Spindle 8 is rigidly attached to one or more fingers 4.

One or more weights 16 having weight apertures 18 sized to slidably admit spindle 8 may be emplaced on spindle 8 by sliding spindle 8 through weight aperture 18 as indicated by arrow 26 in FIG. 3.

When a desired number of weights 16 have been emplaced on spindle 8, an exerciser wearing belt 20 may attach belt hook 24 to exercise arm 2. Belt hook 24 is attached to belt 20 by means of belt line 22. The exerciser may then perform squat exercises as desired, with weights 16 as well as the weight of exercise arm 2 exerting force downwards against upward motion of the exerciser while returning to the vertical.

Exercise arm 2 may comprise extension 28 rigidly attached to an end of arm 2 opposite pivot points 6. Extension 28 comprises a plurality of extension apertures 30 sized to admit belt hook 24. Belt hook 24 may be inserted into different extension apertures 30 as indicated by arrows 32 in FIG. 4, in order to accommodate differently sized exercisers.

An exerciser would stand on horizontal surface 14 when using exercise arm 2. Because extension 28 slopes downwardly relative to horizontal surface 14, different extension apertures are at varying heights above horizontal surface 14, as may be more clearly observed in FIG. 4. Thus, changing the extension aperture 30 with which belt hook 24 is engaged has the effect of varying the height above horizontal surface 14 at which belt 22 is attached to exercise arm 2, thus accommodating differently sized exercisers.

FIG. 5 is a right quarter side isometric view of an alternate embodiment exercise arm 2 having a single finger 4, which is pivotally attached to vertical surface 12 at pivot point 6. Spindle 8 is rigidly attached to finger 4.

One or more weights 16 having weight apertures 18 sized to slidably admit spindle 8 may be emplaced on spindle 20 by sliding spindle 20 through weight aperture 18 as explained previously in relation to the two-finger embodiment of exercise arm 2.

When a desired number of weights 16 have been emplaced on spindle 8, an exerciser wearing belt 20 may attach belt hook 24 to exercise arm 2. Belt hook 24 is attached to belt 20 by means of belt line 22. The exerciser may then perform squat exercises as desired, with weights 16 as well as the weight of exercise arm 2 exerting force downwards against upward motion of the exerciser while returning to the vertical.

As in the two-finger embodiment, exercise arm 2 may comprise extension 28 rigidly attached to an end of extension arm 2 opposite pivot point 6. Extension 28 comprises a plurality of extension apertures 30 sized to admit belt hook 24. Belt hook 24 may be inserted into different extension apertures 30, in order to accommodate differently sized exercisers.

Figure 6:
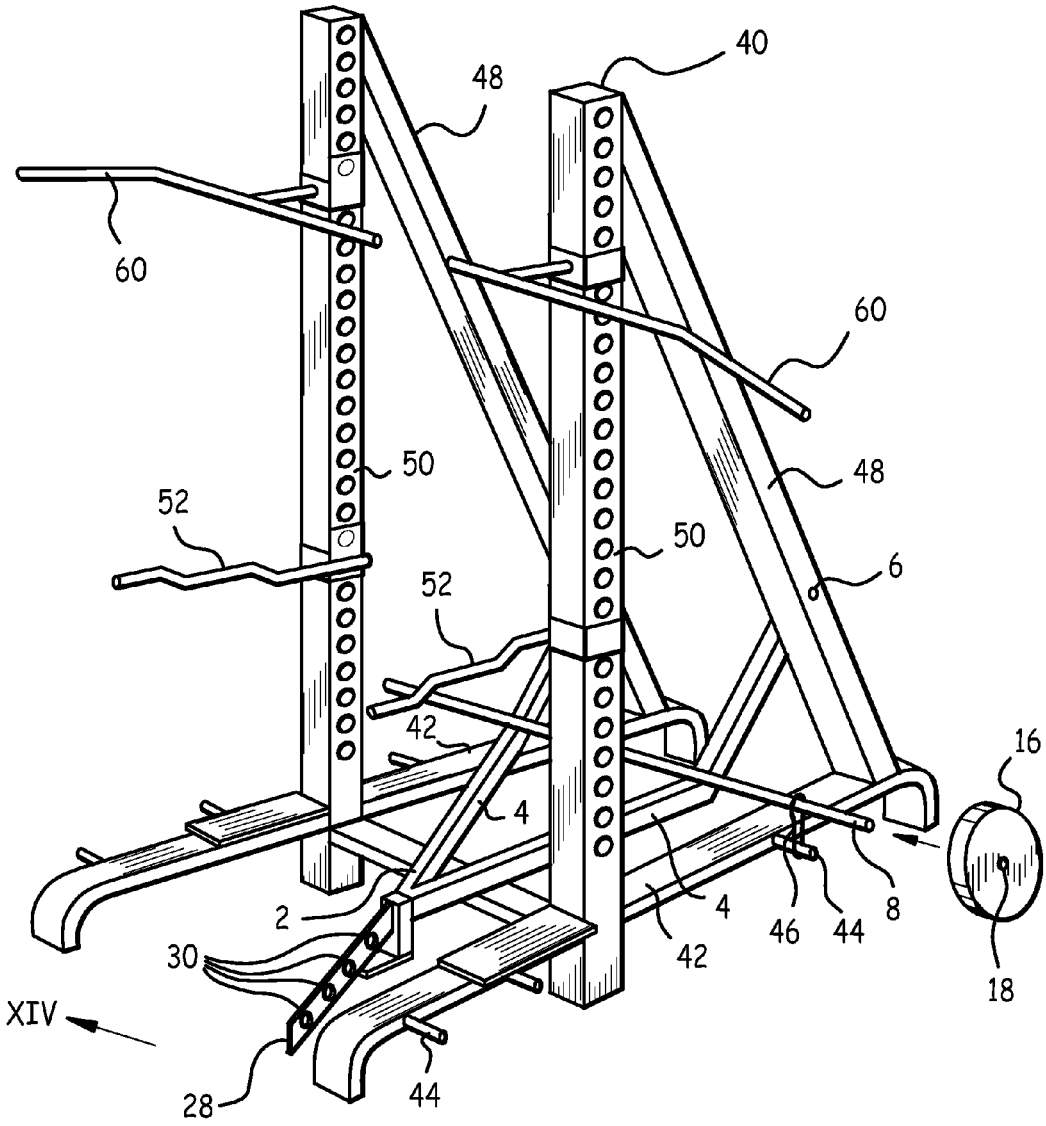
FIG. 6 is a right quarter side isometric view of an exercise arm apparatus pivotally attached to a frame having dip bars and chin bars.

FIG. 6 is a right quarter side isometric view of an alternate embodiment exercise arm 2 pivotally attached to a frame 40 having dip bars 52 and chin bars 60. In this embodiment, forward uprights 50 are high enough to allow chin bars 60 to be height-adjustably attached to them. Each chin bar 60 is substantially horizontal and extend away from its respective front upright 50 in a direction away from exercise arm 2. Height adjustability of chin bars 60 on forward uprights 50 may be accomplished via any appropriate height-adjustment means known in the art.

To perform chins on the apparatus illustrated in FIG. 6, an exerciser installs the weights 16 desired on spindle 8, installs elastic member 46 and/or belt elastic 23 as desired, adjusts the height of chin bars 60 on front uprights 50 to suite the height of the exerciser, dons belt 22, engages belt hook 26 with exercise arm 2, grasps a chin bar 60 with each hand, and performs chin exercises.

In the preferred embodiment, frame 40, exercise arm 2, dip bars 52 and chin bars 60 were made of metal, synthetic, or any other appropriate material. Belt 20 was a conventional exercise weight belt. Weights 16 were commercially available exercise weights. Belt line 22 was any appropriate elongate member, including cable, rope, synthetic, chain, etc. Elastic member 46 and belt elastic 23 were rubber, synthetic, or any other appropriate elongate elastic material.

While a preferred embodiment of the invention has been illustrated herein, it is to be understood that changes and variations may be made by those skilled in the art without departing from the spirit of the appending claims.

DRAWING ITEM INDEX

2 exercise arm
4 finger
6 pivot point
8 spindle
10 arrow
12 vertical surface
14 horizontal surface
16 weight
18 weight aperture
20 belt
21 arrow
22 belt line
23 belt elastic
24 belt hook
26 arrow
28 extension
30 extension aperture
32 arrow
40 frame
42 base
44 peg

46 elastic member
48 rear upright
50 front upright
52 dip bar
54 dip bar first leg
55 dip bar first leg distance
56 dip bar second leg
57 dip bar second leg distance
58 dip bar third leg
59 dip bar third leg distance
60 chin bar

I claim:

1. An exercise arm comprising a finger rotatably attached to a pivot point, a spindle rigidly attached to said finger, a belt and a belt line, said belt line attaching said belt to said exercise arm, at least one weight having a weight aperture sized to slidably admit said spindle, at least one said weight being disposed with said spindle through said weight aperture, and an extension attached to an end of said finger opposite said pivot point, said extension comprising a plurality of extension apertures.

2. The exercise arm of claim 1 further comprising a belt hook attached to an end of said belt line opposite said belt, said belt hook being sized to engage each said extension aperture.

3. An exercise arm comprising a finger rotatably attached to a pivot point, and a spindle rigidly attached to said finger; a frame, said frame comprising a base and rear upright, said rear upright extending upwards from said base, said exercise arm being rotatably attached to said rear upright at a pivot point; a belt and a belt line, said belt line attaching said belt to said exercise arm; at least one weight having a weight aperture sized to slidably admit said spindle, at least one said weight being disposed with said spindle through said weight aperture; and an elastic element, one end of said elastic element being attached to said base, an opposite end of said elastic element being attached to said exercise arm.

4. An exercise arm comprising a finger rotatably attached to a pivot point, and a spindle rigidly attached to said finger; a frame, said frame comprising a base and a rear upright, said rear upright extending upwards from said base, said exercise arm being rotatably attached to said rear upright at a pivot point; a belt and a belt line, said belt line attaching said belt to said exercise arm; at least one weight having a weight aperture sized to slidably admit said spindle, at least one said weight being disposed with said spindle through said weight aperture; and a belt elastic, one end of said belt elastic being attached to said belt, an opposite end of said belt elastic being attached to said exercise arm.

5. An exercise arm comprising a finger rotatably attached to a pivot point, and a spindle rigidly attached to said finger; a frame, said frame comprising a base and a rear upright, said rear upright extending upwards from said base, said exercise arm being rotatably attached to said rear upright at a pivot point; a belt and a belt line, said belt line attaching said belt to said exercise arm; at least one weight having a weight aperture sized to slidably admit said spindle, at least one said weight being disposed with said spindle through said weight aperture; and an extension attached to an end of said finger opposite said pivot point, said extension comprising a plurality of extension apertures.

6. The exercise arm of claim 5 further comprising a belt hook attached to an end of said beltline opposite said belt, said belt hook being sized to engage each said extension aperture.

7. An exercise arm rotatably attached to a frame at a pivot point; said frame comprising a base and two rear uprights extending upwards from said base; said exercise arm comprising two fingers mutually rigidly attached at one end, a spindle attached to said fingers, opposite ends of said fingers being rotatably attached to said frame at pivot points on respective said rear uprights; and a belt and a belt line, said belt line attaching said belt to said exercise arm.

8. The exercise arm and frame of claim 7 further comprising at least one weight having a weight aperture sized to slidably admit said spindle, at least one said weight being disposed with said spindle through said weight aperture.

9. An exercise arm rotatably attached to a frame at a pivot point; said frame comprising a base and two rear uprights extending upwards from said base; said exercise arm comprising two fingers mutually rigidly attached at one end, a spindle attached to said fingers, opposite ends of said fingers being rotatably attached to said frame at pivot points on respective said rear uprights; a belt and a belt line, said belt line attaching said belt to said exercise arm; at least one weight having a weight aperture sized to slidably admit said spindle, at least one said weight being disposed with said spindle through said weight aperture; and an extension attached to an end of said finger opposite said pivot point, said extension comprising a plurality of extension apertures.

10. An exercise arm rotatably attached to a frame at a pivot point; said frame comprising a base and two rear uprights extending upwards from said base; said exercise arm comprising two fingers mutually rigidly attached at one end, a spindle attached to said fingers, opposite ends of said fingers being rotatably attached to said frame at pivot points on respective said rear uprights; a belt and a belt line, said belt line attaching said belt to said exercise arm; at least one weight having a weight aperture sized to slidably admit said spindle, at least one said weight being disposed with said spindle through said weight aperture; and said frame further comprising two front uprights, said exercise arm extending between said front uprights, and a dip bar height-adjustably attached to each said front uprights, each said dip bar extending substantially horizontally away from a respective said front upright in a direction substantially away from said rear uprights.

11. The exercise arm and frame of claim 10 wherein each said dip bar comprises a dip bar first leg, a dip bar second leg, and a dip bar third leg; said dip bar first legs being substantially parallel and separated by a dip bar first distance; said dip bar second legs being substantially parallel and separated by a dip bar second distance; said dip bar third legs being substantially parallel and separated by a dip bar third distance; said dip bar second distance being greater than said dip bar first distance, and said dip bar third distance being greater than said dip bar second distance.

12. An exercise arm rotatably attached to a frame at a pivot point; said frame comprising a base and two rear uprights extending upwards from said base; said exercise arm comprising two fingers mutually rigidly attached at one end, opposite ends of said fingers being rotatably attached to said frame at pivot points on respective said rear uprights; said exercise arm further comprising a spindle attached to said fingers, a belt and a belt line, said belt line attaching said belt to said exercise arm; at least one weight having a weight aperture sized to slidably admit said spindle, at least one said weight being disposed with said spindle through said weight aperture; and a chin bar height-adjustably attached to a front upright, each said chin bar being substantially horizontal and extending away from its respective front upright in a direction away from said exercise arm.

13. An exercise arm rotatably attached to a frame at a pivot point; said frame comprising a base and two rear uprights extending upwards from said base;

said exercise arm comprising two fingers mutually rigidly attached at one end, a spindle attached to said fingers, opposite ends of said fingers being rotatably attached to said frame at pivot points on respective said rear uprights; a belt and a belt line, said belt line attaching said belt to said exercise arm; and an elastic element, one end of said elastic element being attached to said base, an opposite end of said elastic element being attached to said exercise arm.

14. The exercise arm of claim 13 wherein said elastic element encircles said spindle and a peg rigidly attached to said base.

15. An exercise arm rotatably attached to a frame at a pivot point; said frame comprising a base and two rear uprights extending upwards from said base; said exercise arm comprising two fingers mutually rigidly attached at one end, a spindle attached to said fingers, opposite ends of said fingers being rotatably attached to said frame at pivot points on respective said rear uprights; a belt and a belt line, said belt line attaching said belt to said exercise arm; and a belt elastic, one end of said belt elastic being attached to said belt, an opposite end of said belt elastic being attached to said exercise arm.

16. A method of use for an exercise arm comprising the steps of:

A. Providing an exercise arm comprising a finger rotatably attached to a pivot point, a spindle rigidly attached to said finger, a belt attached to said exercise arm by a belt line, and at least one weight having a weight aperture sized to slidably admit said spindle;

B. Emplacing said at least one weight on said spindle;

C. An exerciser donning said belt; and

D. Said exerciser performing squat exercises.

17. The method of use for an exercise arm of claim 16 comprising the further steps of:

E. Providing an extension rigidly attached to an end of said finger opposite said pivot point, said extension having a plurality of extension apertures;

F. Providing a belt hook attached to an end of said belt line opposite said belt, said belt hook being sized to fit into each said extension aperture; and F. Said exerciser engaging said belt hook into one said extension aperture, whereby said belt hook emplacement is most appropriately located to suit a physique of said exerciser.

18. A method of use for an exercise arm comprising the steps of:

A. Providing an exercise arm rotatably attached to a frame at a pivot point; said frame comprising a base and two front uprights extending upwards from said base; and said exercise arm comprising at least one finger rotatably attached to said frame at a pivot point points, a spindle attached to said finger, at least one weight having a weight aperture sized to slidably admit said spindle, a belt and a belt line, said belt line attaching said belt to said exercise arm, and a dip bar height-adjustably attached to each said front upright, each said dip bar extending substantially horizontally away from a respective said front upright in a direction substantially away from said rear uprights;

B. Emplacing said weights on said spindle;

C. An exerciser donning said belt; and

D. Said exerciser grasping said dip handles and performing dip exercises, while said at least one weight resists said exerciser's upwards motion.

19. The method of use for an exercise arm of claim 18 comprising the further steps of:

E. Providing in each said dip bar a dip bar first leg, a dip bar second leg, and a dip bar third leg; said dip bar first legs being substantially parallel and separated by a dip bar first distance; said dip bar second legs being substantially parallel and separated by a dip bar second distance; said dip bar third legs being substantially parallel and separated by a dip bar third distance; said dip bar second distance being greater than said dip bar first distance, and said dip bar third distance being greater than said dip bar second distance; and F. Said exerciser choosing whether to grasp said dip bar first legs, said dip bar second legs, or said dip bar third legs, depending on a physique of said exerciser.

20. The method of use for an exercise arm of claim 18 comprising the further steps of providing an elastic element; attaching one end of said elastic element to said base; attaching an opposite end of said elastic element to said exercise arm; and said exerciser performing dips while said elastic element resists said exerciser's upwards motion.

21. The method of use for an exercise arm of claim 18 comprising the further steps of providing a belt elastic; attaching one end of said belt elastic to said belt; attaching an opposite end of said belt elastic to said exercise arm; and said exerciser performing dips while said belt elastic resists said exerciser's upwards motion.

22. The method of use for an exercise arm of claim 18 comprising the further steps of:

E. Providing an extension rigidly attached to an end of said finger opposite said pivot point, said extension having a plurality of extension apertures;

F. Providing a belt hook attached to an end of said belt line opposite said belt, said belt hook being sized to fit into each said extension aperture; and G. Said exerciser engaging said belt hook into one said extension aperture, whereby said belt hook emplacement is most appropriately located to suit a physique of said exerciser.

23. A method of use for an exercise arm comprising the steps of:

A. Providing an exercise arm rotatably attached to a frame at a pivot point; said frame comprising a base, and two front uprights extending upwards from said base; and said exercise arm comprising at least one finger rotatably attached to said frame at a pivot point, a spindle attached to said finger, at least one weight having a weight aperture sized to slidably admit said spindle, a belt and a belt line, said belt line attaching said belt to said exercise arm, and a chin bar height-adjustably attached to each said front upright, each said chin bar being substantially horizontal and extending away from its respective front upright in a direction away from said exercise arm;

B. Emplacing at least one said weight on said spindle;

C. An exerciser donning said belt; and

D. Said exerciser grasping said chin handles and performing chin exercises, while said at least one weight resists said exerciser's upwards motion.

24. The method of use for an exercise arm of claim 23 comprising the further steps of providing an elastic element; attaching one end of said elastic element to said base; attaching an opposite end of said elastic element to said exercise arm; and said exerciser performing chins while said elastic element resists said exerciser's upwards motion.

25. The method of use for an exercise arm of claim 23 comprising the further steps of providing a belt elastic; attaching one end of said belt elastic to said belt;

attaching an opposite end of said belt elastic to said exercise arm; and said exerciser performing chins while said belt elastic resists said exerciser's upwards motion.

26. The method of use for an exercise arm of claim 23 comprising the further steps of:

E. Providing an extension rigidly attached to an end of said finger opposite said pivot point, said extension having a plurality of extension apertures;

F. Providing a belt hook attached to an end of said belt line opposite said belt, said belt hook being sized to fit into each said extension aperture; and G. Said exerciser engaging said belt hook into one said extension aperture, whereby said belt hook emplacement is most appropriately located to suit a physique of said exerciser.

* * * * *